United States Patent [19]

Evans et al.

[11] Patent Number: 5,040,353

[45] Date of Patent: Aug. 20, 1991

[54] SYSTEM FOR INSPECTING AND RECYCLING GOODS FROM DEFECTIVE PACKAGES ON A BLISTER PACKAGING MACHINE

[75] Inventors: Rix E. Evans, Wendell; David W. Loar, Apex, both of N.C.

[73] Assignee: Glaxo Inc., Research Triangle Park, N.C.

[21] Appl. No.: 558,523

[22] Filed: Jul. 26, 1990

[51] Int. Cl.[5] ..... B65B 47/02; B65B 57/10

[52] U.S. Cl. ..... 53/54; 53/453; 53/53; 53/900; 209/644

[58] Field of Search ..... 53/54, 53, 52, 494, 53/495, 900, 560, 454, 453, 559; 209/644, 580, 524; 250/561, 562

[56] References Cited

U.S. PATENT DOCUMENTS

| | | | |
|---|---|---|---|
| 2,008,870 | 7/1935 | Little | 53/53 X |
| 2,922,445 | 1/1960 | Osmond et al. | 141/170 |
| 3,686,059 | 8/1972 | Auer | 156/581 |
| 3,882,316 | 5/1975 | Garris | 53/53 X |
| 3,889,447 | 6/1975 | Garris | 53/53 |
| 3,980,180 | 9/1976 | Jamieson | 209/644 X |
| 4,094,129 | 6/1978 | List | 53/54 |
| 4,094,439 | 6/1978 | List | 53/54 X |
| 4,172,526 | 10/1979 | Moser | 209/644 X |
| 4,405,049 | 9/1983 | Deitz | 209/644 X |
| 4,472,922 | 9/1984 | Romagnoli | 53/53 |
| 4,802,323 | 2/1989 | Garris et al. | 53/53 |
| 4,916,883 | 4/1990 | Focke | 53/53 |
| 4,964,262 | 10/1990 | Moser et al. | 53/53 X |

FOREIGN PATENT DOCUMENTS

| | | | |
|---|---|---|---|
| 2638934 | 3/1978 | Fed. Rep. of Germany . | |
| 2924428 | 12/1980 | Fed. Rep. of Germany | 53/54 |
| 3202022 | 8/1982 | Fed. Rep. of Germany . | |
| 2059381 | 4/1981 | United Kingdom . | |

*Primary Examiner*—James F. Coan

*Attorney, Agent, or Firm*—Richard E. Jenkins

[57] ABSTRACT

A pneumatic apparatus for withdrawing and recycling goods from defective blister packages on a blister packaging machine comprising a housing which is positioned on the blister packaging machine between the detection station and the sealing station and having a plurality of transversely spaced-apart open chambers in the bottom thereof. A plurality of air valves are connected to a high air pressure source and to the blister package machine detection station, and each air valve corresponds to a respective chamber in the bottom of the housing. A plurality of air venturi nozzles are provided wherein each air venturi nozzle is fluidly connected at its air pressure input end to a corresponding air valve and chamber. Each nozzle comprises a goods transportation conduit connected to its air exhaust exhaust end so the air venturi nozzle will create a partial vacuum in the chamber fluidly connected thereto and a pressurized air flow in the goods transportation conduit at the air exhaust end thereof when the air valve corresponding thereto is opened. Upon receiving a signal from the detection station, the pneumatic goods recycling apparatus will pneumatically withdraw the goods from predetermined portions of a carrier strip from which blister sections will be separated and which each have at least one empty cell therein and then propel the goods back to the blister packaging machine hopper.

26 Claims, 9 Drawing Sheets

SYSTEM FOR INSPECTING AND RECYCLING GOODS FROM DEFECTIVE PACKAGES ON A BLISTER PACKAGING MACHINE

DESCRIPTION

1. Technical Field

The present invention relates to a machine for the production of blister packages, and more particularly to a system for inspecting the blisters of the carrier strip to detect missing goods from blister sections and to pneumatically withdraw and recycle the goods from blister sections with one or more empty blisters prior to the sealing station 2. Background Art In conventional state-of-the-art blister packaging machines, such as Uhlmann intermittent motion blister machines, the blister package formation essentially proceeds as follows. First, a roll stock or carrier strip enters the forming station where a set of punches and dies dimensioned to the correct blister layout forms a pattern of blister sections (for example, five 2×5 sections across the carrier strip width) in which goods such as pharmaceutical tablets or capsules will be subsequently deposited. Next, the carrier strip with the blister cavities formed therein advances to the feeding station where the goods are placed in the blisters. Subsequent to the feeding station of the blister packaging machine, a detection station verifies the presence of the goods (for example, pharmaceutical tablets or capsules) in each cell or blister of each blister section across the width of the carrier strip. This inspection task may be accomplished by suitable electromechanical or electronic means including optical scanning. If one or more cells of one or more blister sections are determined to be empty, this is noted in the electrically connected programmable logic computer (PLC) so as to reject the defective blister sections. For example, if one pharmaceutical tablet in a 2×5 section is missing, the entire blister section is considered to be defective, and the PLC will cause the completed blister package to be rejected at the end of the blister packaging process.

The carrier strip now advances to the sealing station where a suitably printed lidding stock or cover strip is thermobonded to the carrier strip so as to hermetically seal the blisters within the carrier strip. The carrier strip with the lidding stock thermobonded thereto now advances through a cooling station to the perforating station where the individual blister packages are separated or sheared from across the width of the thermobonded carrier strip. For example, five 2×5 blister packages may be separated from across the width of the advancing thermobonded carrier strip corresponding to the blister pattern previously created at the forming station. Finally, vacuum-actuated transfer cups are used to transfer the individual blister packages to a subsequent conveyor unless an error signal is received from the PLC indicating that a specific blister package is defective due to having one or more empty blisters therein. In that circumstance, the vacuum-actuated transfer cup corresponding to that blister package does not engage the blister package and allows it to fall into a reject bin. Unfortunately, it is now commonly necessary to dispose of the contents of the defective packages since retrieval of the remaining goods therein is not commercially feasible with known technology. This can result in a considerable increase in manufacturing cost since the goods are typically costly and the number of defective packages can be significant.

For example, one conventional recovery method entails processing the defective blister packages through a special punch-and-die apparatus wherein the punch pushes the goods out of the blister package through the lidding layer. For pharmaceutical tablets, this presents an elegance problem since the recovered tablets suffer substantial breakage as well as acquiring specks of ink thereon which mar the appearance thereof for recycled usage. Yet another goods recovery method entails shearing of the cavities formed in a blister package in order to release the goods (for example, pharmaceutical tablets or capsules) contained therein. This method also has been found to be unsatisfactory with pharmaceutical tablets since particles of foil and/or polymer from the packaging materials become intermingled with the recovered goods and tend to prevent recycling thereof.

A third goods recovery technique consists of having a blister packaging machine operator manually insert goods into empty blisters between the goods feeding and sealing stations of a blister packaging machine. This procedure would be feasible if only an occasional empty cavity were created in the use of a blister packaging machine for packaging goods such as pharmaceutical tablets or capsules. However, as is well known to those familiar with the commercial use of blister packaging machines, the typical situation is that when sporadic goods feeding occurs, multiple goods misfeeds result in multiple empty blisters. This renders it impractical to manually insert the product into empty blisters during commercial use of the blister packaging machine.

Thus, the blister packaging machine art has to this date only been able to deal with incompletely filled blister packages by segregating the defective packages from the non-defective packages at the end of the blister package forming process. Also, all known apparatus to recycle goods from the incompletely filled or defective blister packages have been found to be less than satisfactory with certain types of goods such as pharmaceutical tablets Representative of related patented art is Romagnoli U.S. Pat. No. 4,472,922 which discloses a system for monitoring the operation of a blister packaging machine. The system comprises a photo-detector to scan the carrier strip between the filling and sealing stations to detect any empty blisters. When an empty blister is detected, a perforator is actuated so as to punch a hole in the top strip which will overlay the empty blister. The signal from the photo-detector to the perforator is also provided to a delay circuit which actuates a sorter downstream of the cutting station to eliminate the entire defective blister package from the machine output. An alarm signal is generated if a second photo-detector positioned prior to the cutting station does not detect the hole and create a pulse which coincides with a pulse read-out from the delay circuit. Also, U.S. Pat. Nos. 3,889,447 and 3,882,316 disclose a quality control monitor for a blister packaging machine. The patents disclose the photo-electric examination of fully formed blister packages in order to locate defective packages and to selectively remove the defective packages from a conveyor line with an air blast from a suitable air nozzle. Offenlegungsschrift 29 24 428 discloses a blister packaging machine which utilizes an optical detector system comprising a light source and video camera to detect empty blisters. When an empty package blister is detected, the detection system provides a signal to a sorter which acts to discard the defective blister package.

SUMMARY OF THE INVENTION

In accordance with the invention, applicant provides a pneumatic system for inspecting and recycling goods on a blister packaging machine during the formation of the blister packages and prior to the sealing station. This system obviates the problem of lost profits due to the discarding of partially filled defective blister packages as well as the heretofore unsatisfactory efforts to punch out or cut open blister cavities in order to recover the goods therefrom subsequent to blister package formation.

The pneumatic goods recovery apparatus is used in conjunction with a conventional blister packaging machine. The apparatus comprises a housing positioned on the blister packaging machine between the detection station and sealing station thereof so that the carrier strip will pass thereunder. The housing comprises a plurality of transversely spaced-apart open chambers defined in the bottom surface thereof wherein each chamber corresponds to a blister section across the width of the carrier strip which will be formed into a predetermined configuration blister package (for example, 2×5) at the subsequent blister package forming station. A high pressure air source is connected to a plurality of air valves wherein each air valve is operatively connected to a respective one of the chambers and has actuator means operatively connected to the blister package machine detection station. A plurality of air venturi nozzles are provided wherein each air venturi nozzle is fluidly connected at its air inlet end to a corresponding air valve and housing chamber and includes a goods transportation conduit connected to its air exhaust end.

The air venturi nozzle is adapted to create both a partial vacuum in the chamber connected therewith and a pressurized air flow in the goods transportation conduit when the air valve corresponding thereto is opened. In this fashion, upon receiving a signal from the detection station, the goods recycling apparatus will pneumatically withdraw the goods from predetermined portions of the carrier strip from which blister packages will be formed and which each have at least one empty blister therein and transport the goods away from the carrier strip in the pressurized air flow of the goods transportation conduit. The goods are preferably transported directly to the container hopper of the blister packaging machine although, alternatively, they could be remotely collected for later use. In this fashion, goods from defective blister packages can be continuously recycled during the blister package formation process on the blister packaging machine so as to obviate the problems associated with either disposing of defective partially-filled blister packages or attempting to punch out or cut open the cavities of fully formed but defective packages in order to recycle the goods therein.

It is therefore the object of this invention to provide a system for inspecting and recycling goods from defective packages during the blister package formation process on a blister packaging machine.

It is another object of this invention to reduce the waste associated with segregating and disposing of defective blister packages formed on a blister packaging machine.

It is another object of this invention to provide a pneumatic apparatus which can be readily installed on an existing blister packaging machine in order to continuously withdraw and recycle goods from defective blister packages prior to sealing and segregation of the defective packages on the blister packaging machine.

It is still another object of the present invention to provide an apparatus to reduce waste on a blister packaging machine and thereby enhance profitability of the manufacturing process for the goods being blister packaged.

Some of the objects of the invention having been stated, other objects will become evident as the description proceeds, when taken in connection with the accompanying drawings

DETAILED DESCRIPTION OF A PREFERRED EMBODIMENT

Figure 1:
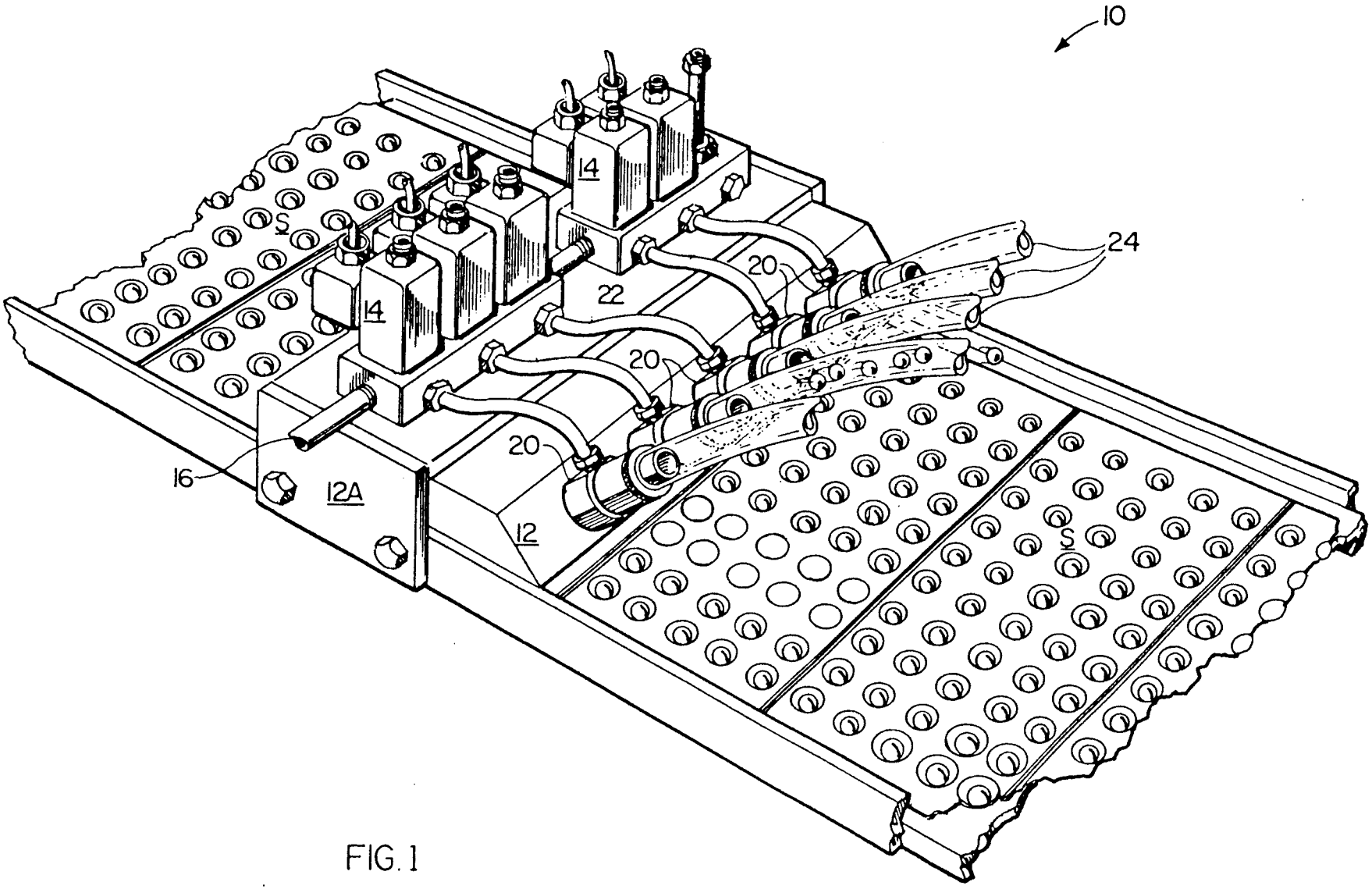
FIG. 1 shows a perspective view of the apparatus of the invention with a carrier strip passing thereunder.
Figure 2:
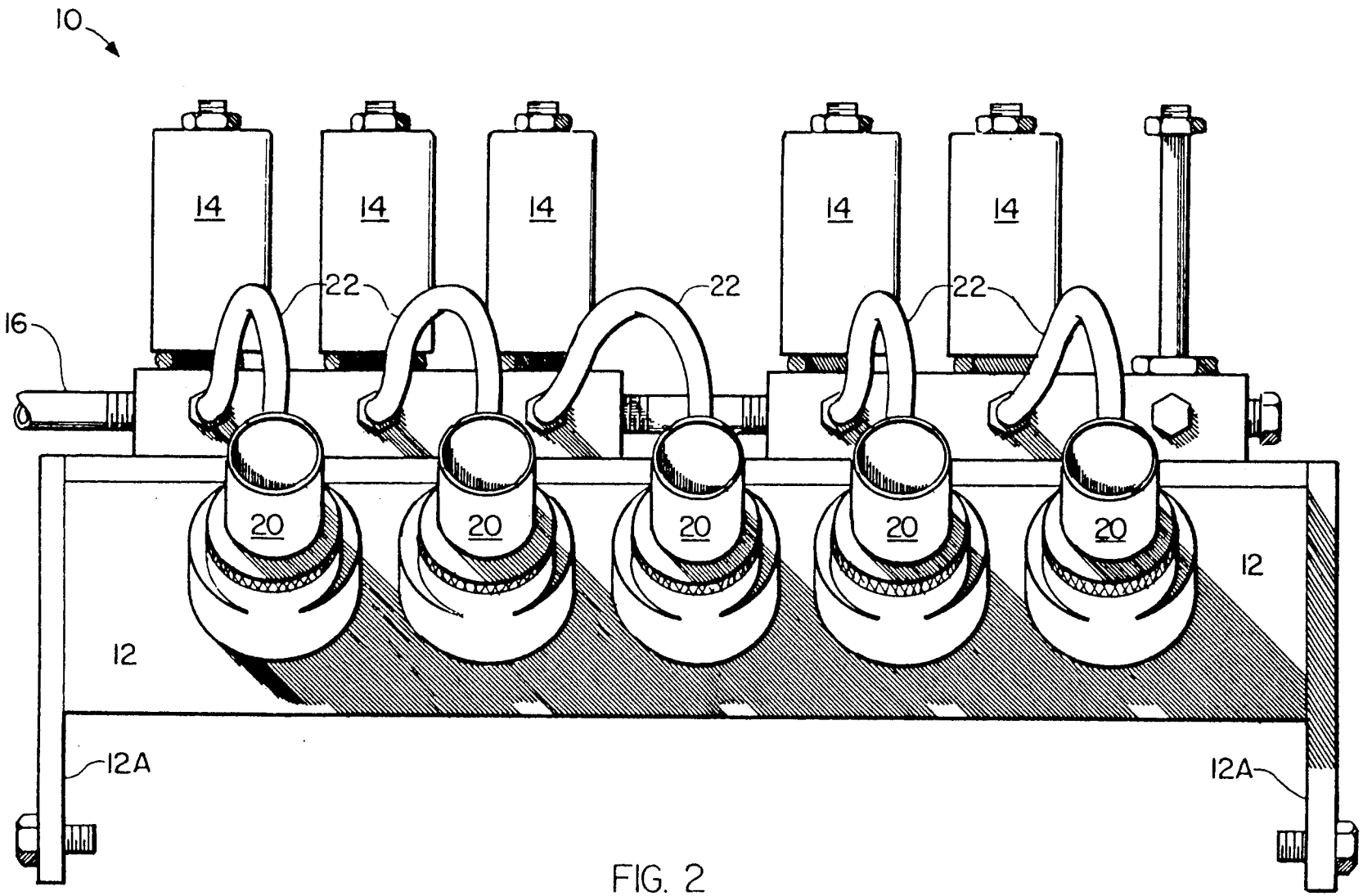
FIG. 2 shows a front elevational view of the apparatus of the invention.
Figure 3:
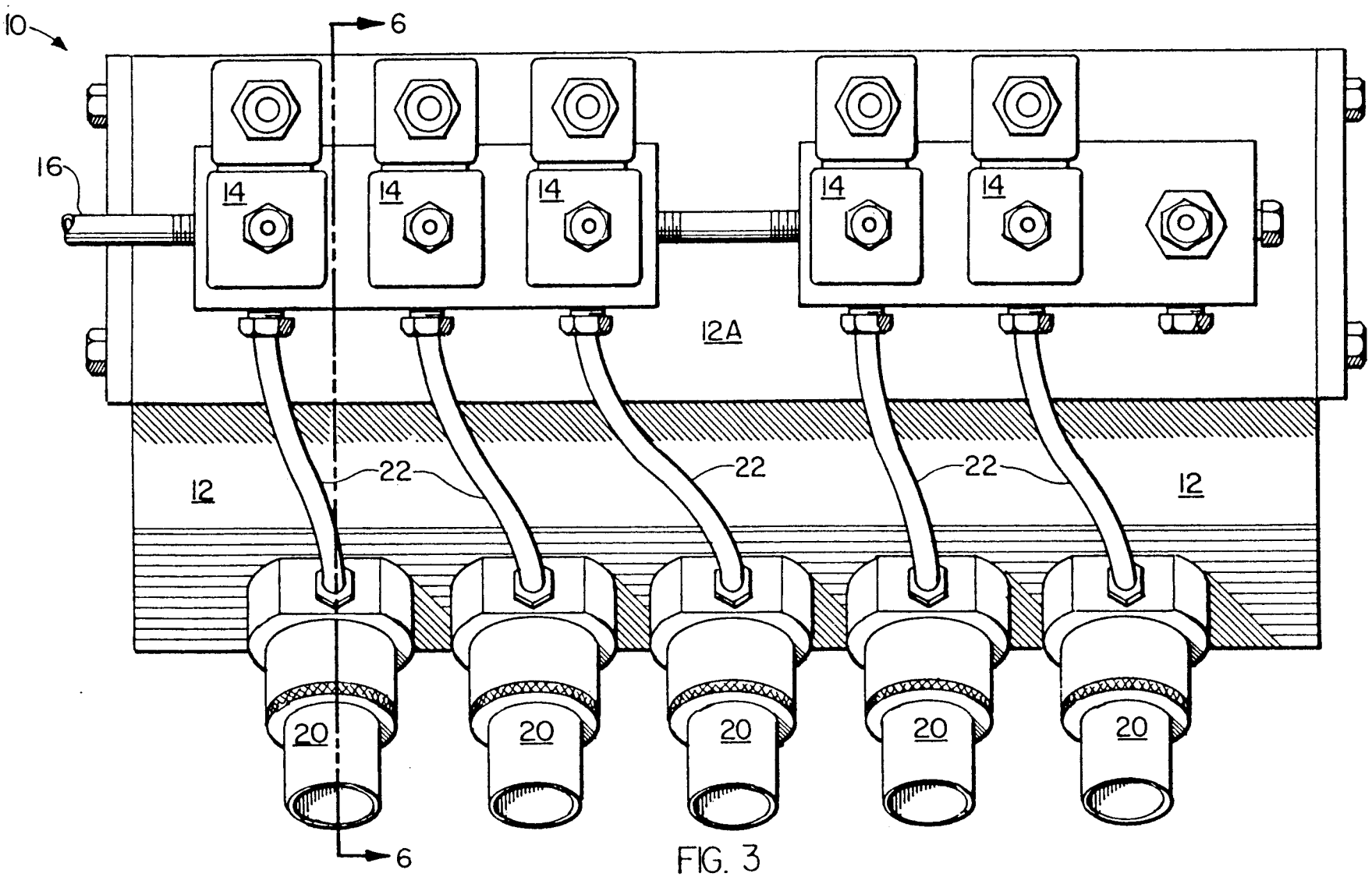
FIG. 3 shows a top plan view of the apparatus of the invention.
Figure 4:
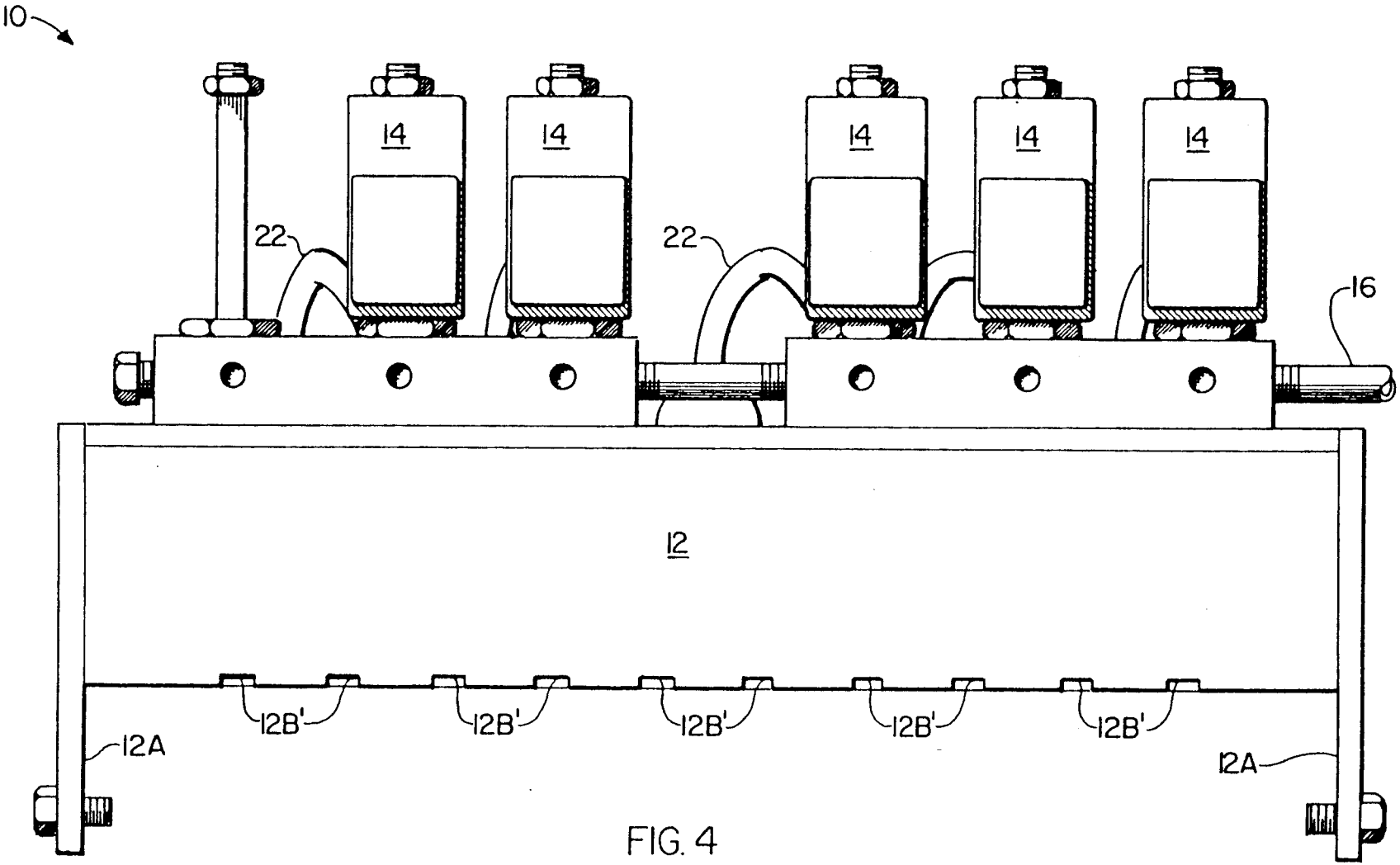
FIG. 4 shows a back elevational view of the apparatus of the invention.
Figure 5:
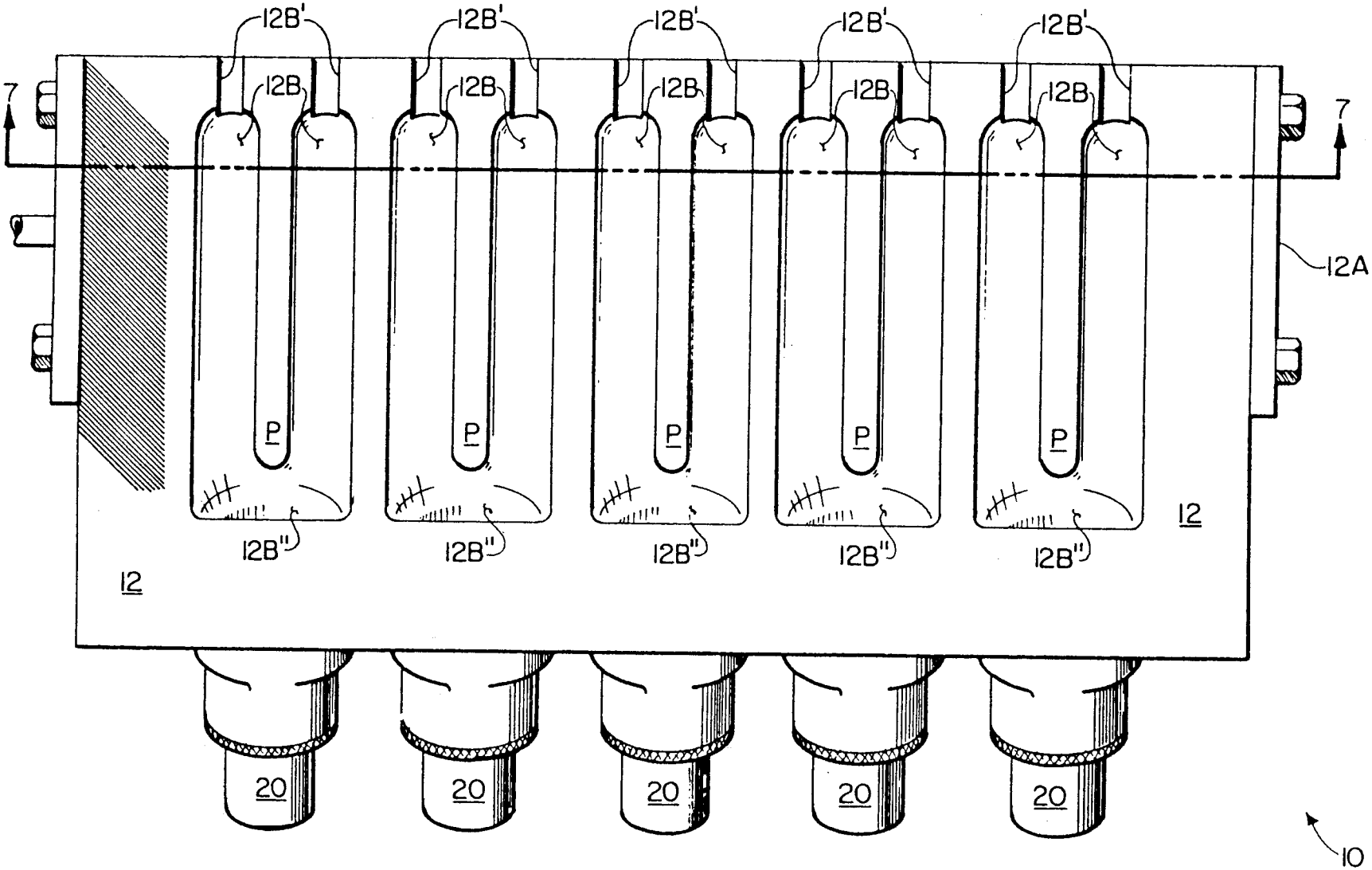
FIG. 5 shows a bottom plan view of the apparatus of the present invention.

Referring now more specifically to the drawings, a preferred embodiment of a pneumatic system for recycling goods from defective packages on a blister packaging machine according to the present invention is shown in FIGS. 1–8 and generally designated 10. Apparatus 10 is particularly well suited for use on Uhlmann intermittent motion blister packaging machines, although applicant contemplates that the apparatus may also be used with other commercial blister packaging machines.

Goods recycling apparatus 10 comprises a housing 12 which is mounted to the blister packaging machine between the inspection and sealing stations by a housing support member 12A. Although the construction materials are a matter of design choice, housing 12 may be machined from DELRIN available from Piedmont Plastics, Inc. in Raleigh, N.C., and housing support member 12A may be formed from aluminum or other suitable high strength material. Housing 12 defines a plurality of open chambers or channels 12B in the bottom surface thereof which will be positioned in close proximity to and in fluid communication with carrier strip S which passes therebeneath and will be described in more detail hereinafter. Open chambers 12B defined by housing 12 will correspond in size and number to the blister section layout which is formed across the width of carrier strip S. For example, if the blister forming station of the blister packaging machine is set up to form a blister layout of five 2×5 sections across the width of carrier strip S (which will ultimately be formed into five 2×5 blister packages), housing 12 will suitably define five elongate and transversely spaced-apart open chambers 12B in the bottom surface thereof which substantially correspond in size and position to the 2×5 blister sections formed across the width of carrier strip S. Also, although other configurations are possible, it is preferred that chambers 12B each include a medial partition P (see FIG. 5) along a portion of the length thereof.

As one skilled in the blister packaging art will fully appreciate, the size and number of chambers 12B would vary depending upon the pattern of blisters formed at the blister forming station at the front end of the blister packaging machine. However, it is essential that chambers 12B closely approximate the size of the blister sections or matrices (for example, 2×5 sections) which pass therebeneath and that chambers 12B be in very close physical proximity thereto (for example, spaced apart about 0.125 to 0.250 inches). The importance of the close positioning of housing 12 over carrier strip S will be more fully appreciated as the description continues. Chambers 12B each further include two slots 12B' at the back end thereof which extend through the back wall of housing 12 (see FIGS. 4, 5, and 6) and a port 12B'' which extends from the front end of channel 12B through the front wall of housing 12 (see FIGS. 5 and 6).

Air valves 14 are mounted to housing 12, and each air valve 14 is operatively associated with a respective chamber 12B formed in the bottom of housing 12. For example, in apparatus 10 shown in the drawings, there are five air valves 14 which are each provided to correspond with a respective one of the five chambers 12B of the pneumatic goods recycling apparatus 10. Although many types of valves may be used, applicant utilized FESTO Model BMFH-3-3-1/4 solenoid valves which may be obtained from Festo Corporation of Charlotte, N.C. Pneumatic valves 14 are two position solenoid valves which are mounted on two manifolds connected by means of FESTO Model BX-M bi-connecting plugs. A high pressure, instrument grade air line 16 is provided to the two interconnected manifolds so that when the normally closed valves are actuated by the solenoids, the valves open and allow high pressure air flow therethrough. When the solenoids are de-energized, the associated valves close, and the high air pressure flow is terminated. The high speed action of solenoid valves 14 (for example, open for about 800 milliseconds) is critical to the functioning of pneumatic goods recycling apparatus 10 since carrier strip S pause time is slightly less than 1000 milliseconds. During that period, the pneumatic apparatus must be able to successfully withdraw all goods (such as pharmaceutical tablets or capsules) from a predetermined defective blister section and then terminate the pneumatic withdrawal process before the next corresponding blister section advances.

Valves 14 are each connected to a corresponding air venturi nozzle 20 by a plastic conduit or tube 22. Each air nozzle 20 is mounted in the port 12B'' of a respective chamber 12B as best seen in FIGS. 1, 2, 5, and 6. Although other air venturi nozzles may be utilized which are capable of providing the necessary dual function of creating a partial vacuum at the inlet end thereof and a positive air flow at the exhaust end thereof, applicant has found the AIR-TEC air flow amplifier Number SS10 to be particularly effective. These air venturi nozzles are available from Air-Tec (Division of C.F.T., Inc.) in Yadkinville, N.C.

Plastic tubes 22 are attached to pressure inlets adjacent pressure inlet ends 20A of air venturi nozzles 20 so that when high air pressure is provided by valves 14 from high pressure air line 16, nozzles 20 will each create a partial vacuum in associated chamber 12B as well as a high pressure air flow at the nozzle exhaust end 20B. In this fashion, when a selected valve 14 is actuated, air flow will be provided through plastic tube 22 to the associated air nozzle 20 which will then create a partial vacuum in chamber 12B for about 800 milliseconds in order to withdraw goods from the blister section immediately therebeneath and then propel the goods through exhaust end 20B thereof. Each nozzle 20 has a plastic conduit or tube 24 connected to exhaust end 20B thereof so as to convey goods from the outlet end back to the hopper (not shown), or other designated receptacle, of the blister packaging machine.

Figure 8:
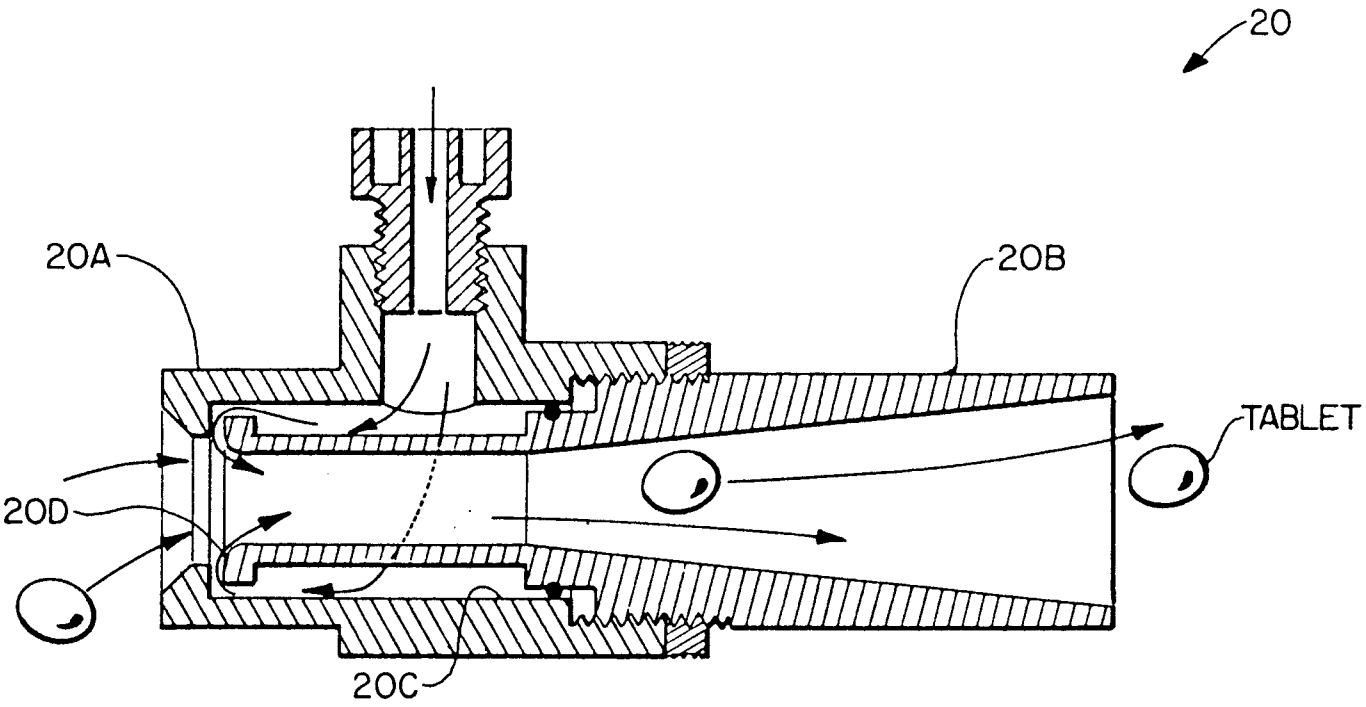
FIG. 8 shows an enlarged vertical section of an air venturi nozzle with a pharmaceutical tablet being withdrawn from a housing channel by the partial vacuum of the nozzle as well as tablets being propelled therefrom back to the blister packaging machine hopper by the positive air flow created thereby.

With particular reference now to FIG. 8 of the drawings, air venturi nozzles 20 will be more fully described. High pressure air flow is provided through plastic tube 22 through the pressure inlet of air venturi nozzle 20 into an annular chamber 20C. The air flow is then throttled through the annular orifice 20C at a very high velocity. The air flow adheres to the profile of the unit and flows over a compound angle 20D which directs it in an air flow path parallel to the axis of the air venturi nozzle. A low pressure area is created within the center of the air nozzle so as to pull a partial vacuum on associated chamber 12B by forcing ambient air into the inlet end 20A of air nozzle 20 and thereby creating a high pressure air flow at the outlet end 20B thereof which is sufficient to transport the goods removed from carrier strips through plastic tube 24 back to the blister packaging machine hopper without any additional air pressure assistance.

With reference again to FIG. 5 of the drawings, applicant would like to note that it is important to the proper functioning of the invention to create a turbulent air flow pattern in chambers 12B in addition to a partial vacuum in order to both raise goods (such as pharmaceutical tablets or capsules) from the blister sections and transport them from chambers 12B and through ports 12B'' into air venturi nozzles 20. Without the turbulent air flow pattern in chambers 12B, the goods may not properly be elevated from the selected cell sections of carrier strip S. With extensive testing, applicant has determined that slots 12B' at the remote ends of channels 12B adjacent to the end of housing 12 and extending therethrough serve to create a desirable turbulence as air flows through the vents into chambers 12B due to the negative draft or partial vacuum induced when the associated air venturi nozzles 20 are actuated. Proper sizing of slots 12B' can be accomplished to assure suitable air turbulence adjacent to the inlet ends of slots 12B' into chambers 12B (see FIG. 6). Also, although the preferred embodiment of apparatus 10 comprises two slots 12B' for each chamber 12B, any suitable member of slots 12B' may be used which result in suitable air turbulence within each chamber 12B.

Figure 6:
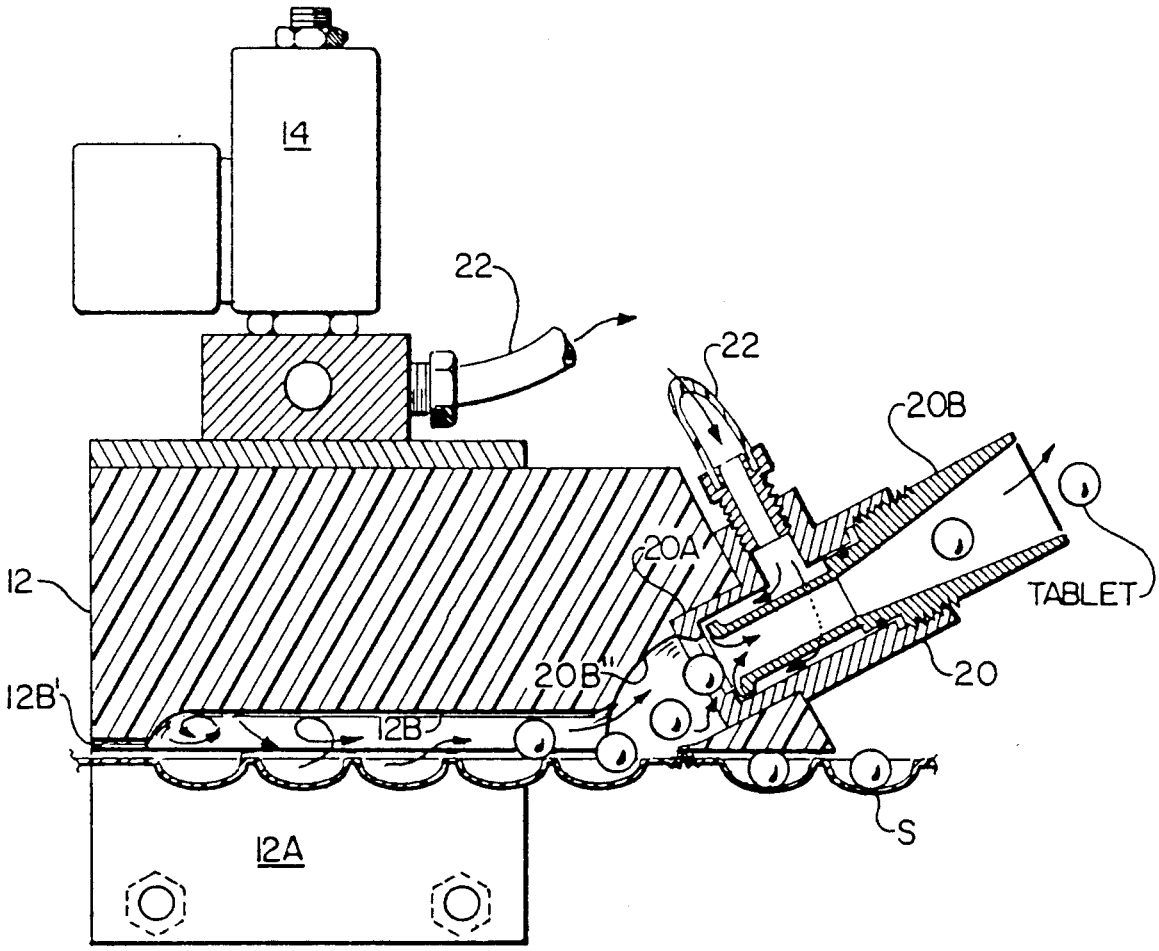
FIG. 6 shows a vertical section along the plane 6—6 in FIG. 3 of the drawings.
Figure 6A:
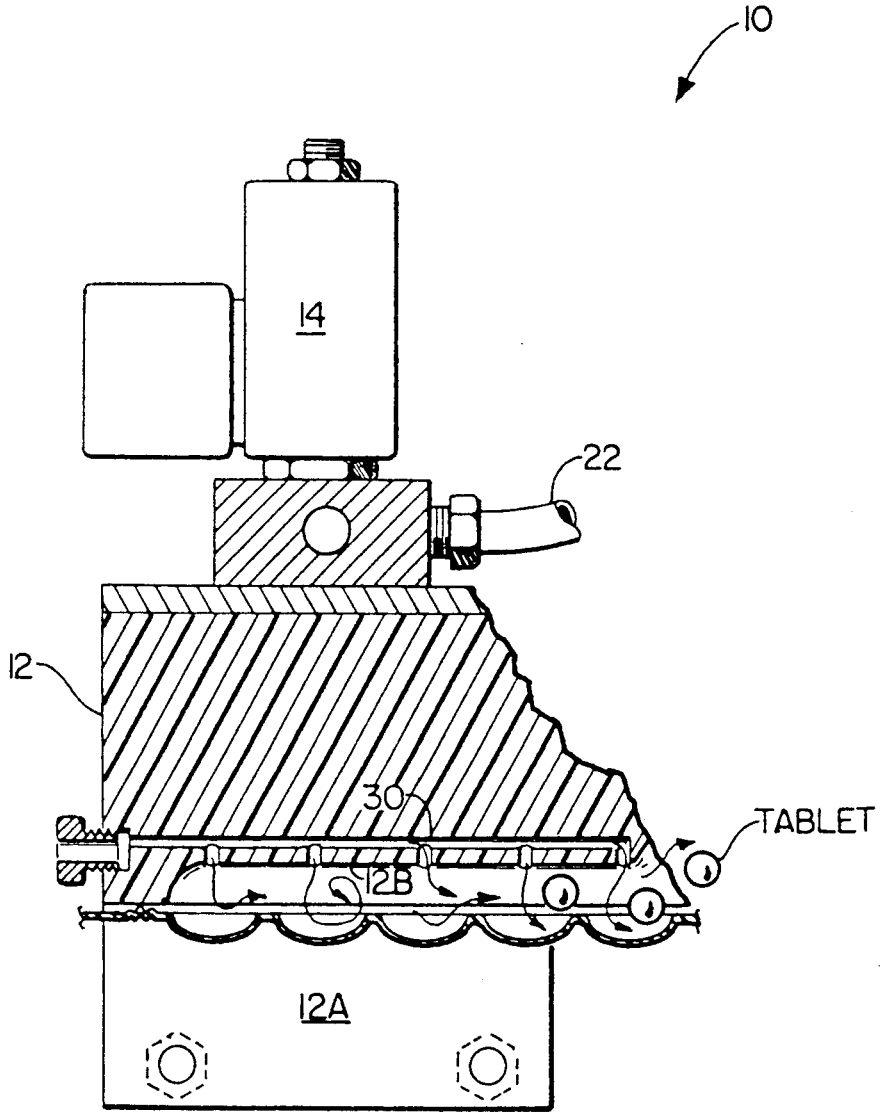
FIG. 6A shows a vertical section similar to FIG. 6 of a second embodiment of the invention using air jets to create chamber turbulence.
Figure 7:
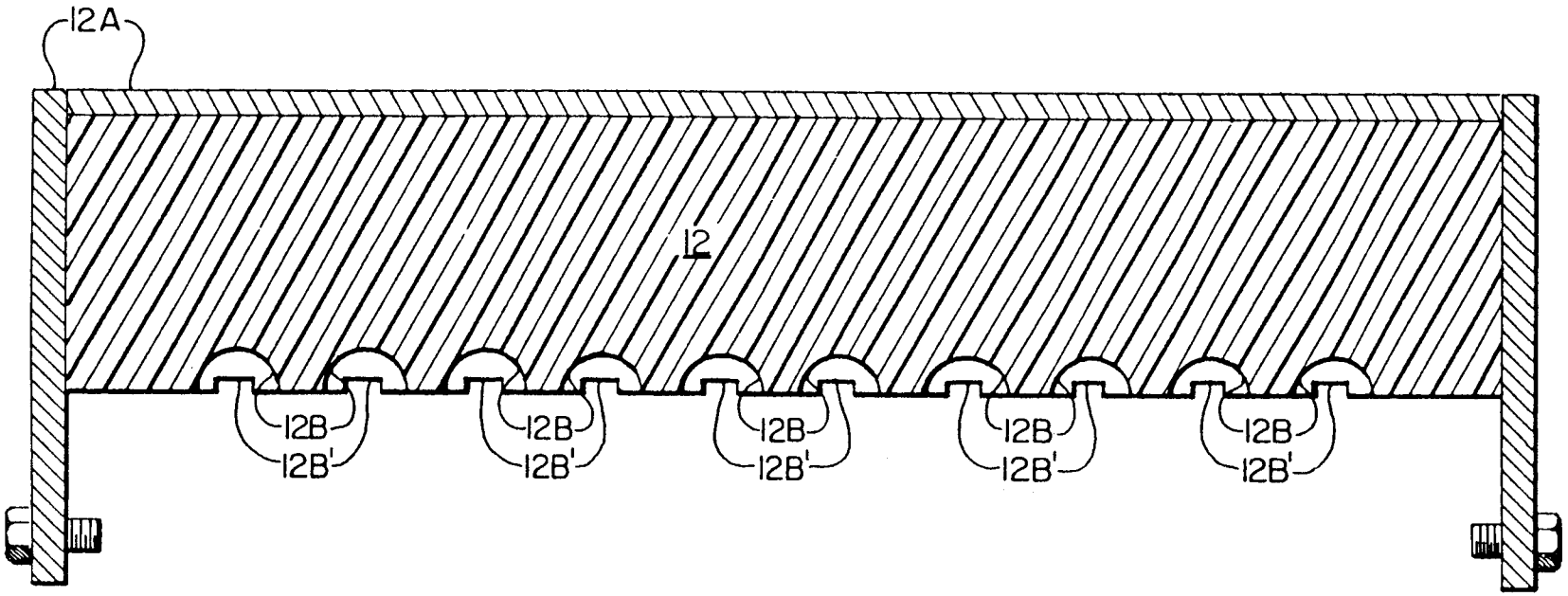
FIG. 7 shows a vertical section taken along the plane 7—7 of FIG. 5 of the drawings.

An alternative arrangement contemplated by applicant is to provide the turbulent air flow within chambers 12B with a suitable header of air swirl jets 30 (see FIG. 6A). Although the construction of the air swirl jets 30 is a matter of design choice, applicant contemplates that at least one air jet will be provided for each chamber 12B and will provide a blast of air at the same time as the associated air nozzle 20 is actuated so as to assist in the discharge and removal of the goods from the selected blister cavities beneath chamber 12B. Although other constructions are possible, each air swirl jet 30 associated with a corresponding chamber 12B may be fluidly connected to corresponding valve 14 so as to be actuated simultaneously with the actuation of the corresponding air nozzle 20 for that chamber.

As noted hereinbefore, pneumatic goods recycling apparatus 10 is mounted between the detection station and the sealing station of the blister packaging machine so that carrier strip S passing therebeneath contains the goods in the open blisters thereof. The goods may be pneumatically removed at this position since the blisters have not as yet progressed to the sealing station where a lidding stock will be thermobonded to the carrier strip in order to hermetically seal the goods in their respective blisters.

Most advantageously, pneumatic goods recycling apparatus 10 may be electrically connected directly to the programmable logic computer (PLC) utilized by the blister packaging machine. For example, the Uhlmann intermittent motion blister packaging machine PLC may be simply reprogrammed so as to indicate to apparatus 10 when a defective blister section is detected across the width of carrier strip S as well as to provide the conventional indication to the sorting station at the end of the machine to segregate defective blister packages from non-defective blister packages. For example, if a missing goods signal is provided to the PLC by the detection station indicating that (by way of example) the first 2×5 blister section of five sections formed across the width of carrier strip S has a missing tablet or capsule, the PLC will provide a signal at two subsequent occasions. Specifically, a signal is provided when the defective blister section of carrier strip S advances beneath goods recycling apparatus 10 so as to actuate first valve 14 and associated air nozzle 20 to draw a partial vacuum in chamber 12B over the defective blister section to withdraw the remaining goods from the blister section and propel them through air nozzle 20 back to the blister packaging machine hopper. The remaining four valves 14 are not actuated. When carrier strip S has advanced beyond recycling apparatus 10 to the sorting station, the PLC again indicates the detected defective first blister section and the now fully-formed but empty blister package is segregated from the non-defective blister packages. Although the PLC shift register utilized by the Uhlmann intermittent motion blister packaging machine is entirely suitable for use to actuate goods recycling apparatus 10, applicant has also found that the standard PLC may be supplemented by an Allen-Bradley Model No. SLC-150 PLC which is available from Allen-Bradley Corporation of Milwaukee, Wis., and other PLC devices are believed to be entirely suitable for actuating both goods recycling apparatus 10 and the conventional sorting station mechanism of the blister packaging machine.

In use, the invention contemplates a blister packaging process providing for the continuous pneumatic recovery and recycling of goods such as pharmaceutical tablets or capsules from defective blister packages during operation of a blister packaging machine so as to prevent any waste product or the need to attempt to punch out or cut open blister cavities of defective blister packages in order to recover goods for re-use. A plurality of blisters are formed across the width of a progressively advancing carrier strip wherein the carrier strip will subsequently be separated across its width into a plurality of blister sections which each contain at least two blisters. The blisters in the carrier strip are filled with goods from a hopper container, and the carrier strip is inspected across the width thereof to determine the presence of empty blisters in the carrier strip prior to separation of the blister sections from the carrier strip at the blister package forming station. Next, a partial vacuum and turbulent air flow is pneumatically created to selectively remove all goods from portions of the carrier strip which will subsequently be separated into individual blister sections when the portions have at least one empty blister, and a high pressure air flow is provided to transport the removed goods away from the empty portions of the carrier strip and return them to the blister packaging machine hopper. The blisters of the carrier strip are sealed with an overlaying strip which is bonded onto the carrier strip so as to hermetically close the blisters, and the blister packages are formed by separating the plurality of blister sections from across the width of the carrier strip. Finally, the empty defective blister packages are segregated from the non-defective blister packages.

It will be understood that various details of the invention may be changed without departing from the scope of the invention. Furthermore, the foregoing description is for the purpose of illustration only, and not for the purpose of limitation—the invention being defined by the claims.

What is claimed is:

1. In combination with a blister packaging machine comprising a hopper containing goods to be packaged, a blister forming station for forming a plurality of blisters in a carrier strip, a blister filling station for introducing the goods to be packaged into the blisters in the carrier strip, a detection station for detecting empty blisters in the carrier strip, a sealing station for bonding a cover strip onto the carrier strip and hermetically closing the blisters in the carrier strip, a blister package forming station for detaching a plurality of blister sections from across the width of the carrier strip wherein each blister section comprises at least two blisters, and a segregating station for separating defective blister sections from non-defective blister sections; a pneumatic goods recovery apparatus for removing goods from predetermined portions of the carrier strip from which blister sections will be formed and which have at least one empty blister, said apparatus comprising:

a housing positioned on said blister packaging machine between the detection station and sealing station thereof so that said carrier strip will pass thereunder, said housing comprising a plurality of transversely spaced-apart open chambers defined in the bottom surface thereof wherein each chamber corresponds to a blister section across the width of the carrier strip which will be formed at the blister package forming station;

a plurality of air valves having a high air pressure source fluidly connected thereto and wherein each air valve is operatively connected with a respective one of said chambers and has actuator means operatively connected to said detection station; and a plurality of air venturi nozzles wherein each air nozzle is fluidly connected at its air input end to a corresponding air valve and its corresponding chamber in the bottom surface of said housing and comprises a goods transportation conduit connected to its air output end, said air nozzle being adapted to create a partial vacuum in said chamber fluidly connected therewith and a pressurized air flow in said goods transportation conduit when said air valve corresponding thereto is opened;

whereby upon receiving a signal from said detection station said goods recycling apparatus will withdraw the goods from predetermined portions of the carrier strip from which blister sections will be formed and which each have at least one empty blister therein and transport the goods away from the carrier strip.

2. The combination defined in claim 1 wherein said housing defines a plurality of parallel and elongate chambers in the bottom surface thereof, said chambers extending parallel to the movement of said carrier strip and each comprising a front port extending through the front wall of said housing and having a respective air venturi nozzle affixed thereto.

3. The combination defined in claim 2 wherein said housing further defines at least one open slot at the end of each open chamber adjacent to and extending through the back wall of said housing so as to generate air turbulence within said chamber when the operatively connected air valve is opened to create a partial vacuum therein.

4. The combination defined in claim 2 wherein said housing further defines at least one air jet for each open chamber also fluidly connected to said corresponding air valve for said chamber so as to generate air turbulence within said chamber when the operatively connected air valve is opened to create a partial vacuum therein.

5. The combination defined in claim 2 wherein said carrier strip defines a plurality of 2×5 blister sections across the width thereof.

6. The combination defined in claim 1 wherein said air valves are in fluid connection with a high pressure air conduit and are normally closed to prevent the high pressure air from being introduced to said air venturi nozzles.

7. The combination defined in claim 6 wherein said air valves are solenoid actuated.

8. The combination defined in claim 1 wherein said air venturi nozzles comprise air flow induction devices.

9. The combination defined in claim 1 wherein said air venturi nozzles are each fluidly connected to a respective air valve by a conduit.

10. The combination defined in claim 1 wherein said goods transportation conduits connected to the output end of said air venturi nozzles are each operatively connected to said hopper so as to recycle said transported goods thereto.

11. The combination defined in claim 1 wherein said goods are pharmaceutical tablets.

12. In combination with a blister packaging machine comprising a hopper containing goods to be packaged, a blister forming station for forming a plurality of blisters in a carrier strip, a blister filling station for introducing the goods to be packaged into the blisters in the carrier strip, a detection station for detecting empty blisters in the carrier strip, a sealing station for bonding a cover strip onto the carrier strip and hermetically closing the blisters in the carrier strip, a blister package forming station for detaching a plurality of blister sections from across the width of the carrier strip wherein each blister section comprises at least two blisters, and a segregating station for separating defective blister sections from non-defective blister sections; a pneumatic goods recovery apparatus for removing goods from predetermined portions of the carrier strip from which blister sections will be formed and which have at least one empty blister, said apparatus comprising:

a housing positioned on said blister packaging machine between the detection station and sealing station thereof so that said carrier strip will pass thereunder, said housing comprising a plurality of transversely spaced-apart open chambers defined in the bottom surface thereof wherein each chamber corresponds to a blister section across the width of the carrier strip which will be formed at the blister package forming station, said chambers extending parallel to the movement of said carrier strip and each comprising a front port extending through the front wall of said housing and at least one open slot at the end thereof adjacent to and extending through the back wall of said housing;

a plurality of air valves having a high air pressure source fluidly connected thereto and wherein each air valve is operatively connected with a respective one of said chambers and has a solenoid actuator operatively connected to said detection station; and a plurality of air venturi nozzles affixed to corresponding front ports in said housing wherein each air venturi nozzle is fluidly connected at its air input end to a corresponding air valve and its corresponding chamber in the bottom surface of said housing and comprises a goods transportation conduit connected to its air output end which is operatively connected to the blister packaging machine hopper, said air nozzle being adapted to create a partial vacuum in said chamber fluidly connected therewith and a pressurized air flow in said goods transportation conduit when said air valve corresponding thereto is opened; whereby upon receiving a signal from said detection station said goods recycling apparatus will withdraw the goods from predetermined portions of the carrier strip from which blister sections will be formed and which each have at least one empty blister therein and transport the goods away from the carrier strip to the hopper.

13. The combination defined in claim 12 wherein said housing defines five parallel and elongate chambers in the bottom surface thereof.

14. The combination defined in claim 13 wherein said carrier strip defines five 2×5 blister sections across the width thereof.

15. The combination defined in claim 12 wherein said air valves are in fluid connection with a high pressure air conduit and are normally closed to prevent the high pressure air from being introduced to said air venturi nozzles.

16. The combination defined in claim 12 wherein said air venturi nozzles comprise air flow induction devices.

17. The combination defined in claim 12 wherein said goods are pharmaceutical tablets.

18. In combination with a blister packaging machine comprising a hopper containing goods to be packaged, a blister forming station for forming a plurality of blisters in a carrier strip, a blister filling station for introducing the goods to be packaged into the blisters in the carrier strip, a detection station for detecting empty blisters in the carrier strip, a sealing station for bonding a cover strip onto the carrier strip and hermetically closing the blisters in the carrier strip, a blister package forming station for detaching a plurality of blister sections from across the width of the carrier strip wherein each blister section comprises at least two blisters, and a segregating station for separating defective blister sections from non-defective blister sections; a pneumatic goods recovery apparatus for removing goods from predetermined portions of the carrier strip from which blister sections will be formed and which have at least one empty blister, said apparatus comprising:

a housing positioned on said blister packaging machine between the detection station and sealing station thereof so that said carrier strip will pass thereunder, said housing comprising a plurality of transversely spaced-apart open chambers defined in the bottom surface thereof wherein each chamber corresponds to a blister section across the width of the carrier strip which will be formed at the blister package forming station, said chambers extending parallel to the movement of said carrier strip and each comprising a front port extending through the front wall of said housing and at least one air jet extending through the upper portion of said housing and into said chamber to facilitate air flow turbulence therein;

a plurality of air valves having a high air pressure source fluidly connected thereto and wherein each air valve is operatively connected with a respective one of said chambers and said air jet therein and has a solenoid actuator operatively connected to said detection station; and a plurality of air venturi nozzles affixed to corresponding front ports in said housing wherein each air nozzle is fluidly connected at its air input end to a corresponding air valve and its corresponding chamber in the bottom surface of said housing and comprises a goods transportation conduit connected to its air output end which is operatively connected to the blister packaging machine hopper, said air nozzle being adapted to create a partial vacuum in said chamber fluidly connected therewith and a pressurized air flow in said goods transportation conduit when said air valve corresponding thereto is opened;

whereby upon receiving a signal from said detection station said goods recycling apparatus will withdraw the goods from predetermined portions of the carrier strip from which blister sections will be formed and which each have at least one empty blister therein and transport the goods away from the carrier strip to the hopper.

19. The combination defined in claim 18 wherein said housing defines five parallel and elongate chambers in the bottom surface thereof.

20. The combination defined in claim 19 wherein said carrier strip defines five 2×5 blister sections across the width thereof.

21. The combination defined in claim 18 wherein said air valves are in fluid connection with a high pressure air conduit and are normally closed to prevent the high pressure air from being introduced to said air venturi nozzles.

22. The combination defined in claim 18 wherein said air venturi nozzles comprise air flow induction devices.

23. The combination defined in claim 18 wherein said goods are pharmaceutical tablets.

24. A blister packaging process providing for the pneumatic recovery and recycling of goods from defective blister packages, comprising the steps of:

forming a plurality of blisters across the width of a progressively advancing carrier strip wherein said carrier strip will be subsequently separated across its width into a plurality of blister sections each containing at least two blisters therein;

filling said plurality of blisters in said carrier strip with goods from a hopper container which are to be blister packaged;

sensing across the width of said carrier strip the presence of empty blisters in said carrier strip prior to separation of said blister sections from said carrier strip;

pneumatically creating a partial vacuum and turbulent air flow to selectively remove all of the goods from portions of said carrier strip which will subsequently be separated into blister sections when said portions have at least one empty blister, and a high pressure air flow to transport said removed goods away from said empty portions of said carrier strip;

sealing said blisters of said carrier strip with an overlaying strip which is bonded onto said carrier strip so as to hermetically close said blisters therein;

forming blister packages containing at least two blisters by separating said plurality of blister sections from said carrier strip across the width of said carrier strip; and sorting defective blister packages from which the goods have been pneumatically removed from non-defective blister packages which have goods in all blisters thereof.

25. A blister packaging process according to claim 24 wherein said goods are pharmaceutical tablets.

26. A blister packaging process according to claim wherein said goods removed from said carrier strip are transported to the hopper container.

* * * * *